US007850322B2

(12) United States Patent
Glazner et al.

(10) Patent No.: US 7,850,322 B2
(45) **Date of Patent: *Dec. 14, 2010**

(54) SWITCH PLATE AREA LIGHT

(75) Inventors: Gregory F. Glazner, Littleton, CO (US); Bowden Ormsbee, Longmont, CO (US)

(73) Assignee: Nite Ize, Inc., Boulder, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/408,057

(22) Filed: Mar. 20, 2009

(65) Prior Publication Data

US 2009/0180274 A1 Jul. 16, 2009

Related U.S. Application Data

(63) Continuation-in-part of application No. 11/279,904, filed on Apr. 17, 2006, now Pat. No. 7,506,990.

(60) Provisional application No. 60/760,626, filed on Jan. 21, 2006.

(51) Int. Cl.
*F21V 33/00* (2006.01)

(52) U.S. Cl. ..... 362/95; 362/96

(58) Field of Classification Search ..... 362/20, 362/85, 95, 96, 147, 149, 183, 249.05, 249.06, 362/260, 176, 277, 28, 2, 290, 291, 322, 362/325, 365, 800, 802; 200/310, 312, 317
See application file for complete search history.

(56) References Cited

U.S. PATENT DOCUMENTS 2,023,819 A 12/1935 Pavelka
3,739,226 A * 6/1973 Seiter et al. ..... 315/86
4,000,405 A * 12/1976 Horwinski ..... 362/95
4,340,826 A 7/1982 Muchnick
4,514,789 A 4/1985 Jester
4,617,613 A * 10/1986 Rice ..... 362/95
4,755,913 A 7/1988 Sleveland
4,774,641 A * 9/1988 Rice ..... 362/95

(Continued)

OTHER PUBLICATIONS

In the US Patent and Trademark Office, Interview Summary After Allowance in re: U.S. Appl. No. 11/279,904, dated Jan. 30, 2009, 2 pages.

(Continued)

*Primary Examiner*—Hargobind S Sawhney
(74) *Attorney, Agent, or Firm*—Patton Boggs LLP

(57) ABSTRACT

A switch plate area light for attachment to an electrical box includes a body having a first aperture adapted to accommodate an element selected from a switch and an outlet, a second aperture adapted to accommodate a screw for attaching the body to the electrical box, and a third aperture located at a light-directing portion of the body. The light further includes a light emitting diode (LED) located in the third aperture, wherein the third aperture is adapted to receive the LED. The light also includes a driver circuit, connected with the LED and mounted on the body, the driver circuit having a pair of wires to be interconnected with the circuitry of the electrical box without the removal of the electrical box, wherein no ground wire is used to connect the driver circuit, and a load borne by the element is not activated when the LED is on.

15 Claims, 8 Drawing Sheets

U.S. PATENT DOCUMENTS

| | | | | |
|---|---|---|---|---|
| 5,473,517 | A | 12/1995 | Blackman | |
| 5,544,025 | A * | 8/1996 | Bohlool et al. | 362/95 |
| 5,660,459 | A | 8/1997 | Appelberg | |
| 5,833,350 | A * | 11/1998 | Moreland | 362/95 |
| 6,000,807 | A * | 12/1999 | Moreland | 362/95 |
| 6,010,228 | A * | 1/2000 | Blackman et al. | 362/95 |
| 6,350,039 | B1 * | 2/2002 | Lee | 362/95 |
| 6,386,725 | B1 * | 5/2002 | Amburgey | 362/95 |
| 6,423,900 | B1 | 7/2002 | Soules | |
| 6,431,719 | B1 | 8/2002 | Lau et al. | |
| 6,547,411 | B1 * | 4/2003 | Dornbusch | 362/95 |
| 6,561,677 | B1 | 5/2003 | Leen | |
| 6,648,496 | B1 | 11/2003 | Elghoroury et al. | |
| 6,805,469 | B1 | 10/2004 | Barton | |
| 6,808,283 | B2 | 10/2004 | Tsao | |
| 6,883,927 | B2 * | 4/2005 | Cunningham et al. | 362/95 |
| 6,943,296 | B2 | 9/2005 | Perrella et al. | |
| 6,965,205 | B2 | 11/2005 | Piepgras et al. | |
| 2004/0246704 | A1 | 12/2004 | Burdick | |
| 2005/0259416 | A1 | 11/2005 | Gauna et al. | |
| 2005/0285547 | A1 | 12/2005 | Piepgras et al. | |

OTHER PUBLICATIONS

In the US Patent and Trademark Office, Interview Summary in re: U.S. Appl. No. 11/279,904, dated Dec. 31, 2008, 2 pages.
In the US Patent and Trademark Office, Notice of Allowability in re: U.S. Appl. No. 11/279,904, dated Dec. 31, 2008, 7 pages.
In the US Patent and Trademark Office, Final Office Action in re: U.S. Appl. No. 11/279,904, dated Apr. 28, 2008, 12 pages.
In the US Patent and Trademark Office, Non-Final Office Action in re: U.S. Appl. No. 11/279,904, dated Dec. 4, 2007, 11 pages.

* cited by examiner

SWITCH PLATE AREA LIGHT

CROSS-REFERENCE TO RELATED APPLICATIONS

This application is a continuation-in-part of U.S. patent application Ser. No. 11/279,904, filed on Apr. 17, 2006, entitled "Switchplate Area Light", which claims the benefit of provisional U.S. Patent Application No. 60/760,626 filed Jan. 21, 2006, all of which applications are incorporated herein by reference.

BACKGROUND OF THE INVENTION

Lights oriented on switch plates or socket plates may be found in the art; however, there are many disadvantages to existing designs. In permanently mounted switch plate installations, prior inventors have generally assumed that a neutral wire was available in the outlet box. For purposes of this application, "permanently mounted" means connected directly to the building wiring, not a plug-in device. A neutral wire is always available in electrical boxes containing outlet receptacles. Unfortunately, many times light is needed where no neutral wire is available. This is commonly the case in electrical boxes containing only a switch or switches. The neutral wire typically resides in the electrical box serving the load, far from the box containing the switch that controls the load. A switch plate light that does not require a neutral wire is needed.

SUMMARY OF THE INVENTION

In order to provide a switch plate light or outlet plate light that functions without the need for a neutral wire, numerous advances are needed. Many issues exist that cannot even be discovered by the basic realization of the need. The presently disclosed switch plate area light addresses the identified need of a switch plate light that can function in the absence of a neutral wire, but goes even further to address additional problems discovered in the creation of the switch plate.

The need for a switch plate light that functions in the absence of a neutral wire is addressed by the realization that a return path through the load may be used. Although, this realization addresses the above-identified need, additional problems are discovered through the usage of a return path through the load. First, if the load of the light on the switch plate is too large, the load (main room light) will be activated by utilization of a return path through the load. To mitigate this, a light that has a small draw is utilized in the presently disclosed switch plate. A single LED is an example presented in the present application; however, alternatives are possible. This is significantly different from the teachings of the prior art, since all directly wired night lights in the prior art make use of multiple LED arrays. If several of these devices were installed on a switch plate, especially a multiple switch plate with 3-way and 4-way switches controlling the same load, the probability of activating the load is great. The LED is deliberately driven below its rated input, resulting in extremely long life. The LED and associated circuitry should last the life of the structure in which it is installed. The light output, nonetheless, is sufficient for adequate nighttime pathway lighting. Because the current draw is low, multiple devices may be connected to the same electrical circuit controlling the same load. This is typically the case with 3-way and 4-way switch installations.

However, the present disclosure realizes that multiple LED night lights are neither necessary nor desirable for the following reasons. White light LEDs generally are very efficient and provide a large amount of light for a given amount of current. Having an excessive amount of light emanating from the LED has a detrimental effect on night vision. One needs an adequate amount of light to see the pathway beneath the switch clearly, but no more. Additional LEDs require additional current; thus, there is more heat generated by the electronics to dissipate behind the switch plate. White LEDs are a relatively expensive component compared to the other electronic parts in the LED drive circuitry. The use of one LED allows the device to be produced more economically.

Another problem discovered is the problem of reactive loads. Because the load functions as a return path for electrical current, it is important to be able to pass current through the load without a significant amount of impedance, as this will dim the light produced by the LED and may also cause a significant amount of LED flickering. If the load is incandescent, it is mostly resistive; and almost any LED driver circuit that functions from an alternating current supply will work, provided it does not draw enough current to activate the load. Many incandescent light bulbs are being replaced by their compact fluorescent equivalents because of their greater efficiency and energy savings. These use an electronic ballast and so present a more reactive load to the LED driver circuitry. It is also possible that the device will be connected to a long tube fluorescent load. In this case, either a magnetic or electronic ballast will be used; thus, again presenting a more reactive load to the LED driver circuitry. The switch plate light addresses these issues by introducing a current regulator connected in a non-standard way into the circuitry to reduce these fluctuations.

Further, a significant advance is that the switch plate light may be installed with little modification to an existing light switch or outlet. It has not been previously realized that all components for the switch plate light may be mounted on the plate itself and hooked into the existing electrical box with two lead wires. Previous devices required the replacement or modification of the electrical box housing the light switch or outlet. Parts and structure are eliminated by the present switch plate light, while still providing area lighting.

Furthermore, the switch plate light is designed to operate without modification with 2-way (SPST), 3-way, and 4-way light switches or any valid combination thereof. The only stipulation is that the switch design (toggle or rocker) be consistent with that of the switch plate. Thus, there are two substantive embodiments of the switch plate, one for each style of switch plate in common use. These are the toggle type and rocker type.

In one embodiment, a switch plate area light for attachment to an electrical box includes a body having a first aperture adapted to accommodate an element selected from the list consisting of a switch and an outlet, the body further having a second aperture adapted to accommodate a screw for attaching the body to the electrical box, and the body further having a third aperture, the third aperture located at a light-directing portion of the body. The switch plate area light further includes a light emitting diode (LED) located in the third aperture, wherein the third aperture is adapted to receive the LED. The switch plate area light also includes a driver circuit, connected with the LED and mounted on the body, the driver circuit having a pair of wires to be interconnected with the circuitry of the electrical box without the removal of the electrical box, wherein no ground wire is used to connect the driver circuit and a load borne by the element is not activated when the LED is on.

In one alternative, the driver circuit draws current from an alternating current power source of the electrical box, such that a return path for the current is through an electrical load of the electrical box. In another alternative, the electrical box is not specifically configured to receive the switch plate area light. In yet another alternative, the light-directing portion of the body protrudes from an outward facing portion of the body. In yet another alternative, the light-directing portion is partially conical. Alternatively, the light-directing portion may face down. In one alternative, a light sensing component is mounted on the front of the switch plate and connected with the driver circuit. In another alternative, the driver circuit is configured to turn off the light emitting diode (LED) when the ambient light reaches a predetermined level. In one alternative, the switch plate area light further includes both an ambient light sensing component and a manually operated switch mounted on the front of the switch plate and associated wiring and modifications to the LED driver circuit configured to turn off the LED when the ambient light reaches a predetermined level and to allow a user to turn off the LED when desired. In another alternative, a first wire of the pair of wires is connected to a hot wire of the electrical box, and the second wire of the pair of wires is connected to a neutral wire of the electrical box. In another alternative, the element is connected to the hot wire and the neutral wire.

In another embodiment, a switch plate area light for attachment to an electrical box includes a body having a first aperture adapted to accommodate an element selected from the list consisting of a switch and an outlet, the body further having a second aperture adapted to accommodate a screw for attaching the body to the electrical box, and the body further having a third aperture, the third aperture located at a light-directing portion of the body. The switch plate area light further includes a light emitting diode (LED) located in the third aperture, wherein the third aperture is adapted to receive the LED. The switch plate area light further includes a driver circuit, connected with the LED and mounted on the body, the driver circuit having a pair of wires to be interconnected with the circuitry of the electrical box without the modification of the electrical box. In one alternative, no modification of the element is needed in order to interconnect the driver circuit. In another alternative, the driver circuit includes a current regulating component including an adjustable three-terminal regulator integrated circuit, the regulator having an input terminal, an adjustment terminal, and an output terminal configured such that rectified and filtered current from the current rectifying and filtering components of said LED driver circuit is applied to the input terminal of the regulator, output current to drive an LED is drawn from the adjustment terminal of the regulator, and the output terminal of the regulator is unused. In yet another alternative, a first wire of the pair of wires is connected to a hot wire of the electrical box, and the second wire of the pair wires is connected to a neutral wire of the electrical box. In yet another alternative, when the LED is on, a load borne by the element is not activated. Alternatively, the element may be connected to the hot wire and the neutral wire. In another alternative, no ground wire is used to connect the driver circuit, and the load borne by the element is not activated when the LED is on.

In one embodiment of a light emitting diode (LED) driver circuit for mitigating the effects of reactance and current fluctuations caused by an electrical load, the LED driver circuit includes a current rectifying component and a current filtering component. The LED driver circuit also includes a current regulating component including an adjustable three-terminal regulator integrated circuit, the regulator having an input terminal, an adjustment terminal, and an output terminal configured such that rectified and filtered current from the current rectifying and filtering components of the LED driver circuit is applied to the input terminal of the regulator, output current to drive an LED is drawn from the adjustment terminal of the regulator, and the output terminal of the regulator is unused. Regulated current is provided to an LED when the LED driver circuit is connected to a hot wire and a neutral wire of an electrical box. In one alternative, the electrical load is connected to the hot wire and the neutral wire.

BRIEF DESCRIPTION OF THE DRAWINGS

In the drawings, closely related figures have the same number but different alphabetic suffixes.

DETAILED DESCRIPTION

In the present description, the part numbers refer to the following items:

20 rocker type switch plate
21 hole for protrusion of rocker type switch
28 light rays emanating from LED
34 hole for mounting screw in rocker type switch plate
36 LED housing
38 LED
40 built-in lens portion of LED
42 anode wire from LED

Figure 1A:
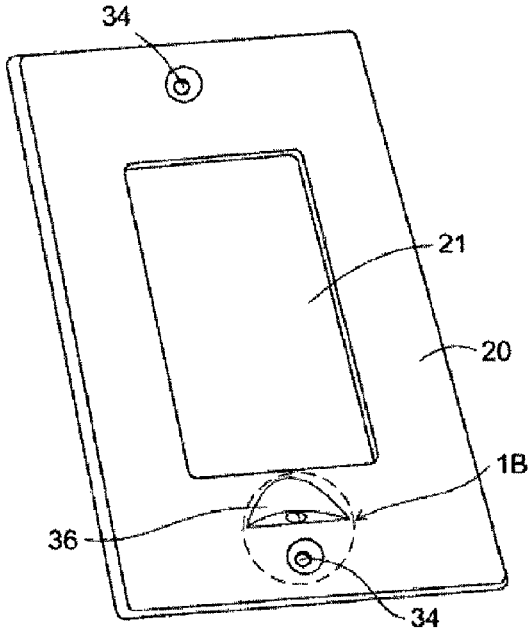
FIG. 1A shows a front perspective view of one embodiment of a rocker type switch plate with mounted LED area light.
Figure 1B:
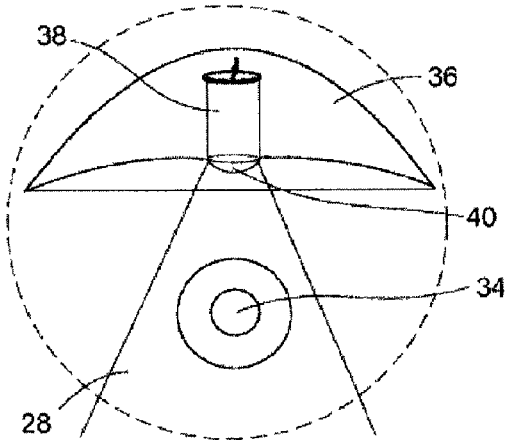
FIG. 1B shows an expanded front view of one embodiment of a rocker type switch plate with mounted LED area light.
Figure 1C:
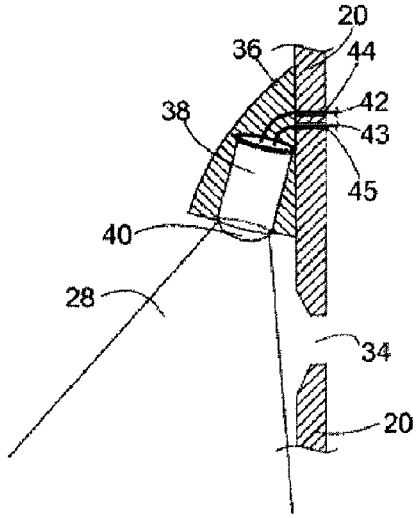
FIG. 1C shows an expanded sectional side view of one embodiment of a rocker type switch plate with mounted LED area light.
Figure 3A:
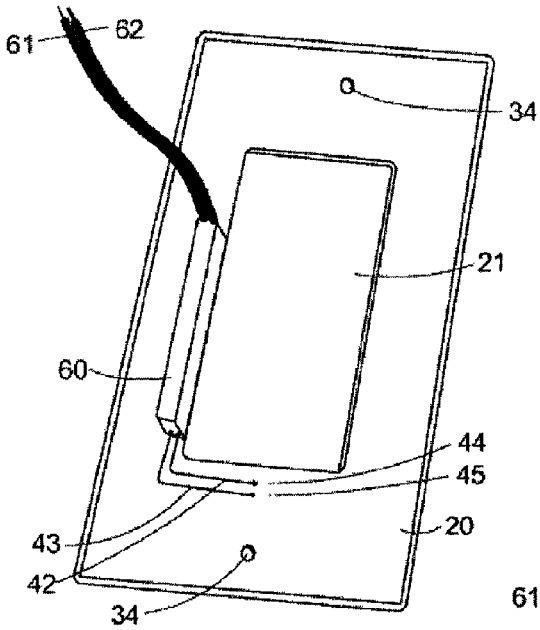
FIG. 3A shows a back perspective view of the rocker switch plate in FIG. 1A showing the mounting of the LED driver circuit assembly.
Figure 3B:
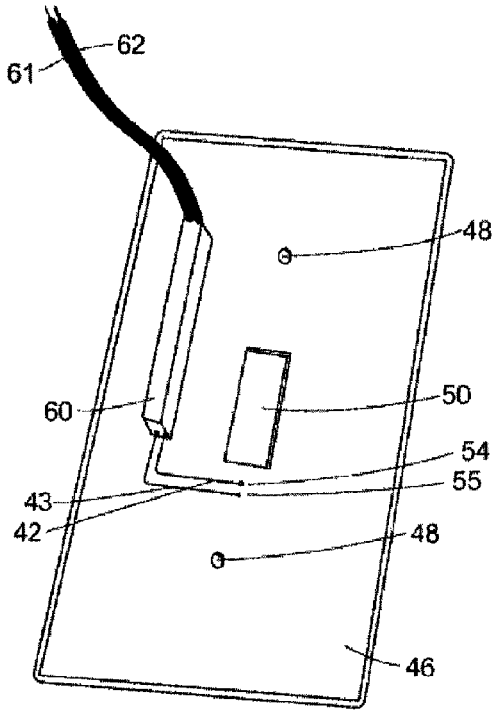
FIG. 3B shows a back perspective view of the toggle switch plate in FIG. 2A showing the mounting of the LED driver circuit assembly.

43 cathode wire from LED
44 hole through rocker type switch plate for anode wire of LED
45 hole through rocker type switch plate for cathode wire of LED
46 toggle type switch plate
48 hole for mounting screw in toggle type switch plate
50 hole for protrusion of toggle type switch
54 hole through toggle type switch plate for anode wire of LED
55 hole through toggle type switch plate for cathode wire of LED
60 LED driver circuit assembly
61 connection wire 1 from LED driver circuit assembly
62 connection wire 2 from LED driver circuit assembly
64 2-way switch
65, 66 2-way switch terminal
67 wire from line
68 wire to load
70 first 3-way switch in circuit
72 second 3-way switch in circuit
74 first traveler wire between switches
76 second traveler wire between switches
78 terminal of 3-way switch for connection to line
80 terminal of 3-way switch for connection to load
82 connection of LED driver assembly to terminal on switch connected to first traveler wire for the 3-way switch connected to line
84 connection of LED driver assembly to terminal on switch connected to second traveler wire for the 3-way switch connected to load
86 connection of LED driver assembly to terminal on switch connected to first traveler wire for the 3-way switch connected to line
88 connection of LED driver assembly to terminal on switch connected to second traveler wire for the 3-way switch connected to load
90 first 3-way switch in circuit utilizing a 4-way switch
92 second 3-way switch in circuit utilizing a 4-way switch
94 4-way switch
96 terminal of 3-way switch for connection to line
98 terminal of 3-way switch for connection to load
100 first traveler wire between 3-way switch connected to line and 4-way switch
102 second traveler wire between 3-way switch connected to line and 4-way switch
104 first traveler wire between 3-way switch connected to load and 4-way switch
106 second traveler wire between 3-way switch connected to load and 4-way switch
108 connection of LED driver assembly to first traveler wire terminal of 3-way switch connected to line
110 connection of LED driver assembly to second traveler wire terminal of 3-way switch connected to line
112 connection of LED driver assembly to first 4-way switch terminal on load side of switch
114 connection of LED driver assembly to second 4-way switch terminal on load side of switch
116 connection of LED driver assembly to first traveler wire terminal of 3-way switch connected to load
118 connection of LED driver assembly to second traveler wire terminal of 3-way switch connected to load
120 connection of LED driver assembly to first 4-way switch terminal on line side of switch
122 connection of LED driver assembly to second 4-way switch terminal on line side of switch
220 rocker type switch plate with opening for ambient light sensor
221 rocker type switch plate with opening for manually operated switch
222 ambient light sensor
252 manually operated switch to turn off LED One embodiment of a switch plate area light is illustrated from the front in FIG. 1A and from the back in FIG. 3A. A cylindrical LED 38 is fitted into a housing 36 on the structure of the switch plate 20 at such an angle that the light rays 28 emanating from the LED 38 provide illumination on the pathway below the switch plate. Other than the leads 42 and 43 exiting the LED 38 which protrude though holes 44 and 45 in the switch plate 20, the LED 38 is mounted on the front of the switch plate 20. The housing 36 surrounding the LED 38 is of such a composition that it allows some light to escape. Alternatively, the switch plate 20 itself may be modified to provide an enclosure for the LED 38 that angles it away from the plane of the switch plate in the same manner as with a separate housing 36. LED 38 has a lens 40, and LED 38 protrudes from housing 36.

The LED driver circuit 60 is positioned on the back of the switch plate 20. LED driver circuit 60 may be fixed to switch plate 20 according to a variety of methods including, but not limited to, snap fit, glue, friction, and other mechanical attachment devices such as screws. The LED driver circuit 60 is connected to the LED 38 through small holes 44 and 45 in the switch plate 20. This provides a durable, inexpensive structure for both the light source and driving electronics. The LED driver circuit assembly 60 is kept sufficiently thin so as to be able to slip between the body of the existing switch and the side of the electric box. The electrical switch rocker protrudes through opening 21. The switch plate 20 may be secured in place by means of screws through mounting holes 34. Alternative attachment means for the switch plate may be used.

Figure 6:
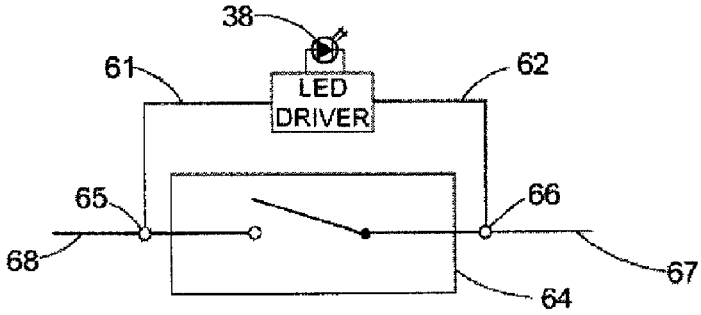
FIG. 6 shows how one embodiment of the switch plate light would be connected to a 2-way switch.
Figure 7:
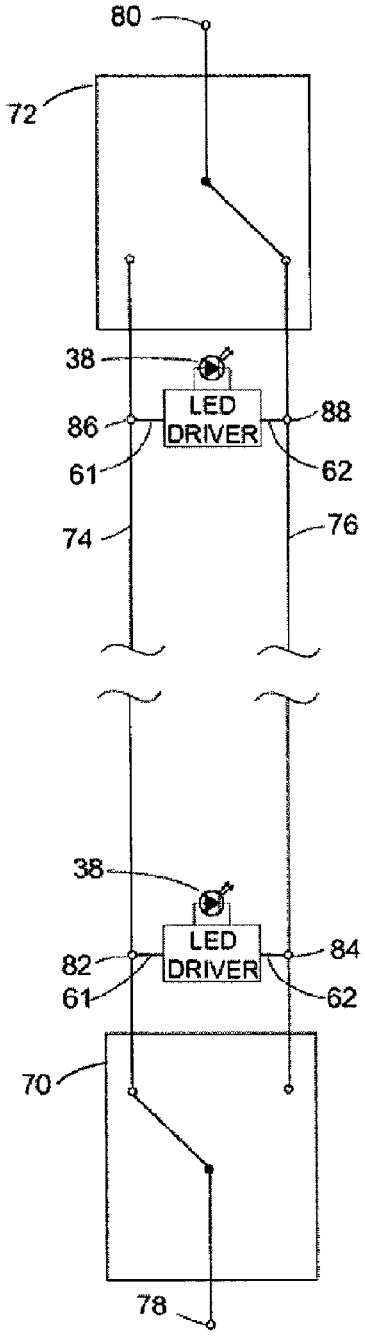
FIG. 7 shows an embodiment of how multiple devices would be connected to a set of 3-way switches.
Figure 8:
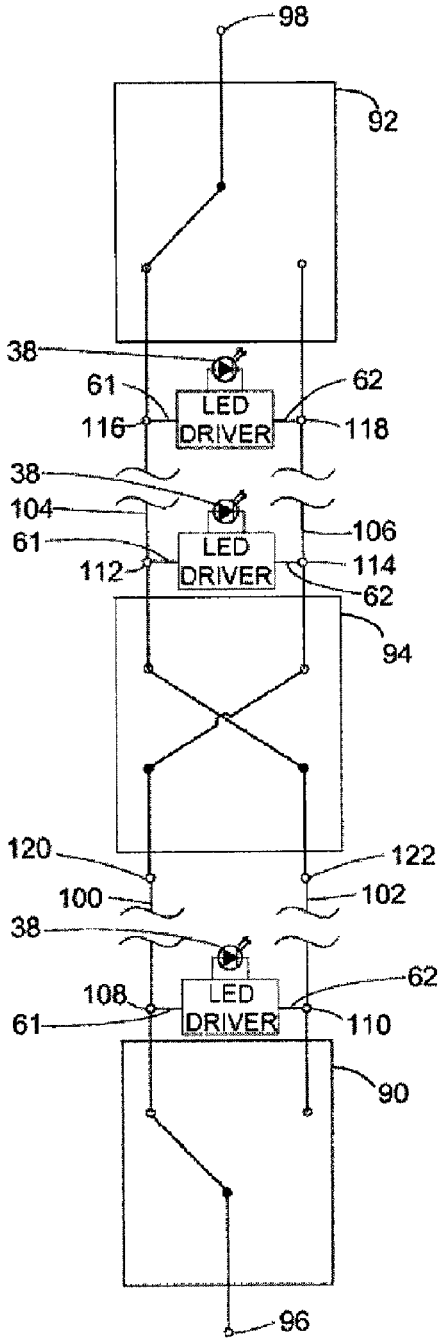
FIG. 8 shows an embodiment of how multiple devices would be connected to a set of 3-way and 4-way switches.

Two wires 61 and 62 emanate from the LED driver circuit assembly 60. These are used to connect the device to the terminals of a 2-way 64, 3-way 70, 72, 90, and 92 or 4-way 94 switch as shown in FIGS. 6, 7, and 8, respectively. In this way, the switch plate light may be attached and installed without any changes to the existing electrical box and the switch or outlet. The elimination of the need for a new electrical box or outlet or switch is achievable due to the low power output required and in some cases the reactance mitigation. Previously, it would not have been thought that a new device mounted on the switch plate could be so easily attached to the existing electrical box and switch/outlet without replacing the electrical box and switch/outlet with one specifically modified to receive the switch plate.

Figure 4:
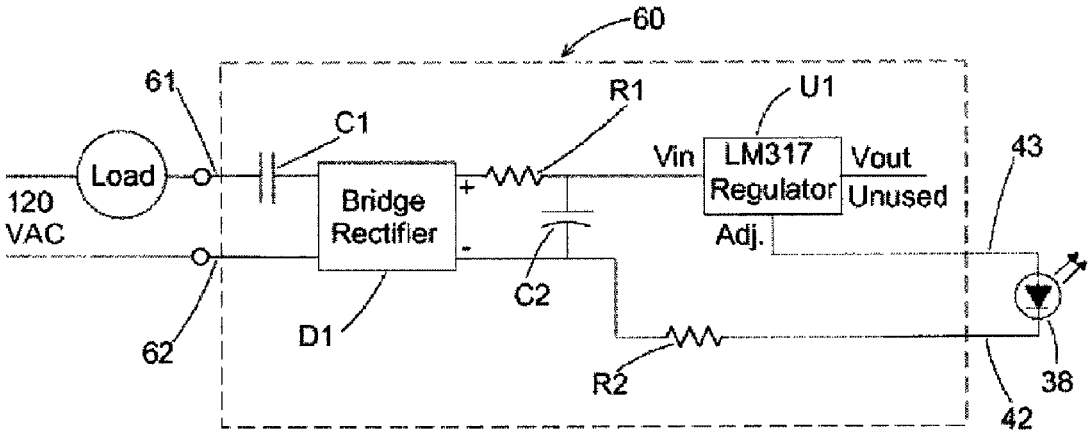
FIG. 4 shows a schematic representation of one embodiment of an LED driver circuitry.
Figure 5:
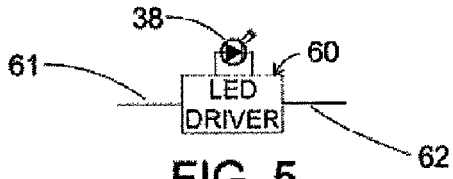
FIG. 5 shows a block diagram representation of the circuit shown in FIG. 4.

The LED driver circuit 60 diagrammed in FIG. 4 and reduced to block form in FIG. 5 consists of a bridge regulator D1 rated at 1A, for example a Rectron RS 104, an adjustable regulator U1, typically an LM317 or equivalent 3-terminal integrated circuit regulator of which only two terminals are used. Capacitors C1 (0.1 uF, 250 v, non-polarized) and C2 (47 uF, 50 v polarized), and resistors R1 (4.7K ohms, ¼w) and R2 (180 ohms, ¼w) complete the components necessary to drive the LED 38. The specific values of the components depend on the electrical characteristics of the LED 38 driven and to the extent of current supplied to the LED 38. This current is typically below the rated maximum for the LED 38.

In operation, the capacitor C1 serves to allow only a part of the alternating current cycle to enter the remainder of the circuit before it becomes fully charged, thus reducing the amount of current that must be dissipated by resistor R1 after rectification by bridge D1. Capacitor C2 serves to filter the output from bridge D1 through resistor R1 before it reaches regulator U1. U1 is configured as a constant current source to mitigate the effect of reactive loads such as compact fluorescent bulbs and long tube fluorescent fixtures. Although this is a 3-terminal device, only two of the pins are used—Pin 3 (input) and Pin 1 (adjust). This is a way of using this component in a circuit not anticipated by the manufacturers. It makes use of the internal current limiting circuitry built into the device. The low currents involved with this circuit allow the use of the LM317 regulator U1 in this manner. Resistor R2 further limits current to the LED 38.

Various fluorescent lighting fixture manufacturers use different, sometimes proprietary circuits in their ballasts. These can cause substantial fluctuations in the current passed through them. This can result in brightening and dimming of LED 38 output without effective current regulation. Because the LM317 regulator U1 is produced in high volume, it is very inexpensive and can replace other current regulating devices.

Many other circuit arrangements and component values could be used to drive the LED 38 through an electrical load. The circuit shown in FIG. 4 is one such circuit that will work for this purpose.

In an application where electronic components are placed inside an electrical box, it may be important to minimize generated heat. The LED driver circuit 60 shown in FIG. 4 generates very little heat. This may be an important safety feature.

A feature of the switch plate is the efficient use of light emitted by the LED 38. LED 38 is mounted in an unusual fashion. Cylindrical LEDs are manufactured to be used in through-hole and base flush configurations. The LED 38 is mounted such that its longitudinal axis is almost parallel with the face of the switch plate 20. The placement of the light source is on the outside of the switch plate 20. Because all cylindrical LEDs have some internal reflection and, therefore, some light leakage around their periphery, this is also put to use by the placement of the LED 38 on the outside of the switch plate 20. This unavoidable light leakage is not wasted but used as an indicator of switch location provided the housing 36 of the LED 38 is made with a material that allows some light to pass.

In one embodiment, the switch plate area light has a very low profile on the wall. Most plastic or nylon switch plates protrude approximately 5 mm from the wall. This LED 38 placement adds only approximately another 5 mm, which is about the same protrusion amount of a rocker switch installed behind the switch plate and is less than the protrusion of a toggle switch. Alternatively, the protrusion may be 5 mm to 15 mm. Alternatively, the protrusion may be 15 mm to 50 mm.

Another feature is the use of a standard size switch plate 20 to carry the LED driver circuit 60. Because it is not unusual for outlet boxes to be installed close to door jambs or other tri m, the switch plate takes up no more lateral space than the switch plate it replaces; thus, it can be used as a switch plate replacement in almost any location.

Operation

There are three types of light switches in common household use: 2-way (SPST) 64, 3-way (SPDT) 70, 72, 90, and 92, and 4-way (DPDT with cross-connect) 94. This switch plate light may be connected to any of these in any electrically valid combination. In addition, multiple devices may be connected to the same lighting circuit to control a specific load. Referring to FIGS. 7 and 8, it is important to note that not all devices shown need to be connected. One is sufficient, but the design allows for devices to be installed on any switch in the circuit. The method of accomplishing this will be explained below. In all cases, when the load is off, current will flow though the LED driver circuit 60 and the LED 38 will be illuminated. When the load is on, no current will flow through the device and the LED 38 will be off.

Note that, in general, as long as the two wires 61 and 62 to the LED driver circuit 60 are connected across traveler wires between switches, the switch plate will work properly. This is because, when the load is off, one traveler wire is connected to the line side of a circuit and the other is connected to the load. This provides a return path for the current utilized by the switch plate because the load is connected to a neutral wire. Detailed electrical connection descriptions for specific switch configurations follow.

1. Connection to a 2-Way (Single Pole, Single Throw—SPST) Switch

Referring to FIG. 6, the wires 61 and 62 emanating from the LED driver circuit 60 are connected to each of the two terminals 65 and 66 of 2-way switch 64. It is irrelevant which wire is connected to which terminal. When the switch is open, current flows from the line side 67 of the switch through the LED driver circuit 60 to the load side 68 of the open switch. Since this side of the switch is connected to the load, there is now a return path for the current and the LED 38 will be illuminated. When the switch is closed, current flows from the line side 67 of the switch to the load side 68 of the switch and the load is energized. No current flows through the LED driver circuit 60, and the LED 38 is not illuminated.

2. Connection to a 3-Way (Single Pole, Double Throw—SPDT) Switch

Referring to FIG. 7, the wires 61 and 62 emanating from the LED driver circuit 60 are connected to terminals 82 and 84 or 86 and 88 feeding the "traveler" wires 74 and 76 between the two 3-way switches 70 and 72 in the lighting circuit. 3-way switches are designed to be used in pairs such that the load may be turned on or off from either switch. Only one of the traveler wires 74 and 76 will be energized at a time depending on the state of the switch 70 connected to the line side 78 of the circuit. The other 3-way switch 72 in the circuit then can energize or not energize the load depending on its position relative to the traveler wires 74 and 76. If it is closed with respect to the energized wire 74, the load will be on. If it is open with respect to the energized traveler wire 74, the load will be off. Because the LED driver circuit 60 is connected between the two traveler wires 74 and 76, one of the wires always will be energized. If the load is off, then current can flow from the traveler wire 74 currently connected to the line through the LED driver circuit 60 via switch terminal 82 or 84 to the other traveler wire 76 via switch terminal 84. This wire is connected through the other 3-way switch 72 to the load 80; thus, a circuit is completed and the LED 38 will be illuminated. When the load 80 is on, no current will flow through the LED driver circuit 60 and the LED will be off. Note that devices may be connected to either or both of the 3-way switches 70 and 72 in the circuit. If a second device is installed, it would be connected between terminals 86 and 88 as shown in FIG. 7. This is particularly useful when it is desired to light both the top and bottom of a stairway at the same time. Note that, if two devices are installed, they are connected in parallel.

3. Connection to a 4-Way (Double Pole, Switched Cross-Connected—DPDT) Switch

Operation of the switch plate light in a circuit containing a 4-way switch is similar to operation in a circuit containing only 3-way switches. 4-way switches are designed to be installed between a pair of 3-way switches, and any number of 4-way switches can be used in a circuit controlling the same load. As in the 3-way case, all LED devices are connected in a parallel fashion. FIG. 8 shows a circuit where three switches 90, 92, and 94 control the same load. Referring to FIG. 8, the connection wires 61 and 62 to the LED driver circuit 60 may be connected to either side of the 4-way switch 94 via terminals 112 and 114 or 120 and 122 for proper operation. A 4-way switch 94 is a switched cross-connection device. When the toggle or rocker is in one position, the switch functions as a straight-through device. For each of the two traveler wires 100 and 102 in this case, the switch functions as a pass-through device to the traveler wires 104 and 106. That is, traveler wire 100 would be connected to traveler wire 104 and traveler wire 102 would be connected to traveler wire 106. In the other toggle position of the switch 94 as shown in FIG. 8, traveler wire 100 is connected to traveler wire 106 and traveler wire 102 is connected to traveler wire 104. This has the same electrical effect of changing the position of the toggle on the load side 98 of the circuit. Detailed operation is as follows: 3-way switch 90 is connected to the line side 96 of a circuit. This energizes traveler wire 100 and also 3-way switch 90 terminal 108 to which the LED driver circuit 60 is connected. The energized traveler wire 100 reaches 4-way switch 94 at its terminal 120. Since the switch 94 toggle is in the cross-connected position in FIG. 8, current flows through the switch to terminal 114 where another LED driver circuit 60 is connected. Traveler wire 106 also is energized because it is connected to 4-way switch 94 terminal 114. 3-way switch 92 is connected to the load through its terminal 98. Due to its toggle position shown in FIG. 8, traveler wire 104 now also is connected to the load through 3-way switch 92 terminal 116. As a result, the driver electronics will be energized and the LED 38 will light. Because traveler wire 104 is connected to terminal 112 on 4-way switch 94, a circuit is completed through the LED driver 60 connected to terminal 112 and the LED 38 will light. Due to the position of the switch toggle for 4-way switch 94, terminal 122 and traveler wire 102 are also connected to the load. The LED driver circuit connected to 3-way switch 90 terminal 110 thus also is connected to the load and the LED 38 will be illuminated. Note that the 4-way switch 94 devices can be connected across either terminals 112 and 114 or 120 and 122.

Alternative Embodiment

Figure 2A:
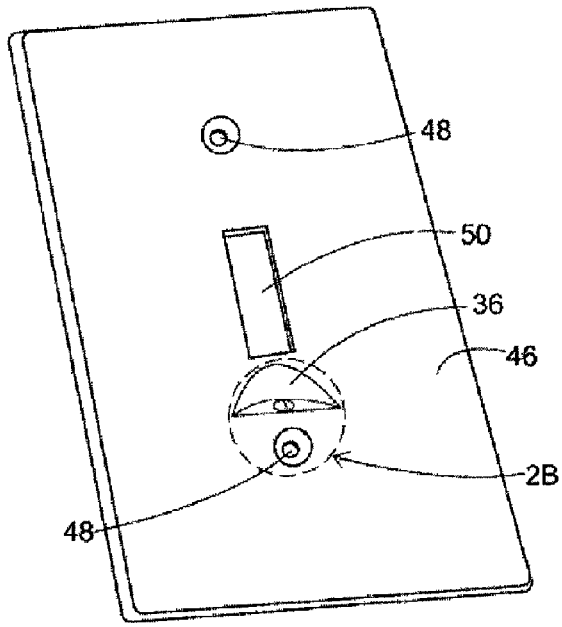
FIG. 2A shows a front perspective view of one embodiment of a toggle type switch plate with mounted LED area light.
Figure 2B:
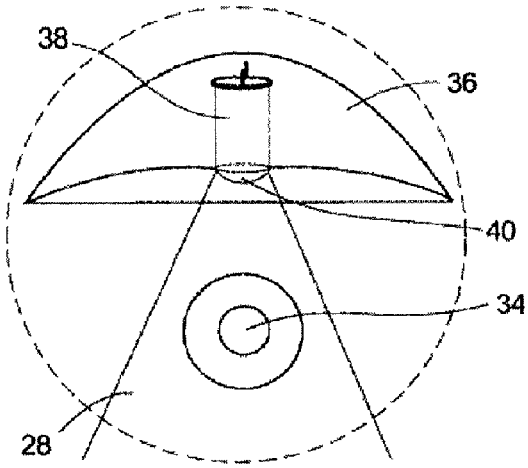
FIG. 2B shows an expanded front view of one embodiment of a toggle type switch plate with mounted LED area light.
Figure 2C:
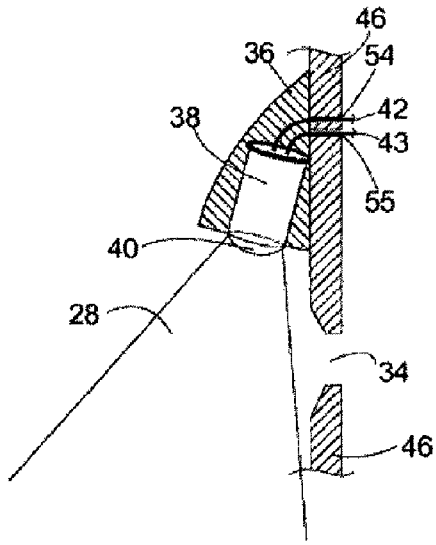
FIG. 2C shows an expanded sectional side view of one embodiment of a toggle type switch plate with mounted LED area light.

An alternative embodiment of the switch plate light includes the use of a toggle type switch plate 46 as in FIG. 2A rather than a rocker type 20 as in FIG. 1A. The toggle of the switch behind the switch plate protrudes through an appropriately sized opening 50. The LED housing 36 and LED driver circuit assembly 60 must be placed in a different area of the switch plate due to the position of the toggle switch mechanism behind the switch plate. Thus, the position of the holes 54 and 55 for routing the LED leads from the front to the back of the switch plate are in a different location than for a rocker type switch plate. The switch plate is secured in place by screws through mounting holes 48. All electronics as in FIG. 4 and connections to a lighting circuit through wires 61 and 62 remain the same.

Additional Alternative Embodiment

The alternative embodiments discussed below can be used singly or combined in any valid combination.

Figure 9:
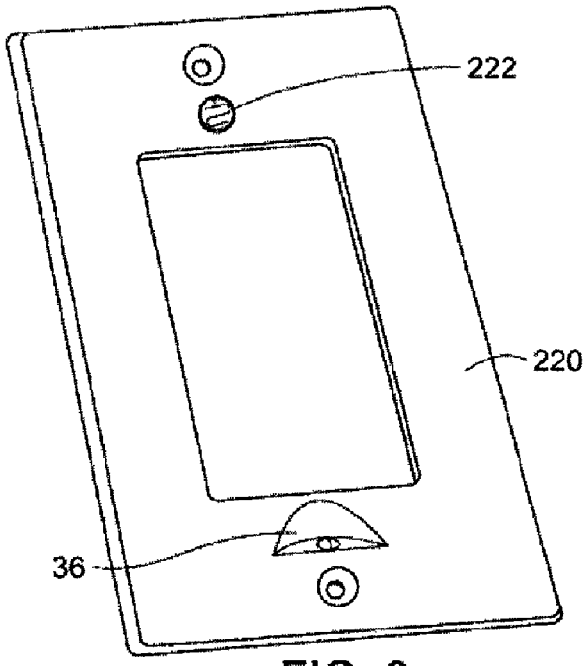
FIG. 9 shows an alternative embodiment incorporating an ambient light sensor.

Although the electronics are very efficient, it is recognized that consumers may not want the LED 38 to be on during higher ambient light conditions. Accordingly, a photoresistor or phototransistor and associated additional circuitry can be incorporated into the design to turn off the LED 38 in higher ambient light conditions. The photosensitive element 222 would be mounted on the side of a switch plate 220 opposite the LED housing 36 with wiring on the back of the switch plate connecting to the drive electronics as shown in FIG. 9. Because, as shown previously, multiple devices in a circuit are electrically connected in parallel, they would operate independently turning on and off the LED 38 in response to ambient light conditions. This installation could be applied to either rocker or toggle switch plates.

Figure 10:
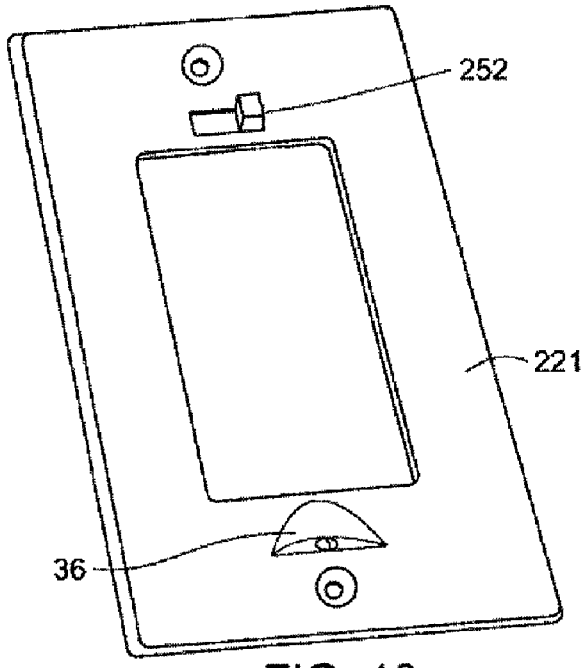
FIG. 10 shows an alternative embodiment incorporating a manually operated on-off switch.

Because this is designed to be a wired-in installation, the LED 38 will remain on as long as power is applied and the load is turned off. Consumers may desire a way to independently turn off the LED 38. This can be accomplished with an additional switch 252 as shown in FIG. 10. Although the switch shown is a slide switch, any other on-off switch would work, provided it will physically fit into the switch plate 221 and will not interfere with the placement of other components. The switch would be wired into the drive electronics to control power to the LED 38. This switch could be installed in either rocker or toggle switch plates.

Although most implementations of the switch plate light will use a visible light LED, an alternative embodiment uses an infrared LED to illuminate an area. This would be useful in installations where security cameras are in use that can image an area illuminated with infrared light. This would be particularly useful in long hallways where the infrared illumination sources typically provided on a surveillance camera cannot reach the full length of an area effectively. In this case, it would make sense to orient the LED toward the ceiling by turning the switch plate 180 degrees to illuminate a larger area, as the emitted infrared radiation would not pose a night vision issue and most security cameras are very sensitive to infrared light.

Another embodiment would involve placing the LED 38 on the outside of a gang or combination switch plate.

Switch plates typically are available in three standard sizes. The LED 38 could be placed on any of them; however, the smallest standard size would be best, as most switch plates produced in this size will fit more installations than larger size switch plates.

The device can be incorporated onto a blank switch plate. This would be useful in places where light is needed and a covered outlet box is available.

Although the device is intended to be powered through a load, it will work equally well when a neutral wire is available. Thus, embodiments will work without modification around a standard dual outlet. In this case, the light generally would not be emitted from as high a location on the wall, but useful light would still be provided without using any outlet space. For older outlets, the LED housing 36 and LED driver circuit 60 could be mounted on a switch plate with plug openings.

To reduce the profile of the switch plate light even more than in the preferred embodiment, part of the LED 38 may be machined down at an angle commensurate with the longitudinal axis of light emission so it may fit more closely to the switch plate. Both of these modifications would leave intact the angle the longitudinal axis of the LED 38 makes with the wall; thus, the light rays 28 generated by the LED 38 would fall in the same place.

Other possible embodiments could place the LED 38 on a location on the switch plate other than below the switch opening and above the switch plate mounting screw. In one embodiment the light may be oriented so that it is not blocked by any obstruction such as, for example, the switch.

LEDs are available in many sizes and shapes. Many types of LEDs other than the cylindrical type could be utilized, including surface mount LEDs.

A fusible link or equivalent electrical component could be incorporated in the electronics shown in FIG. 4. This component would be placed between and in series with lead 61 or 62 as an electrical safety device. A wire of sufficient thinness may be used as a fuse in some embodiments. The thin wire may melt or vaporize in an over current condition. This may be used as a safety feature to prevent the overheating of circuitry or electrical shock.

Figure 11:
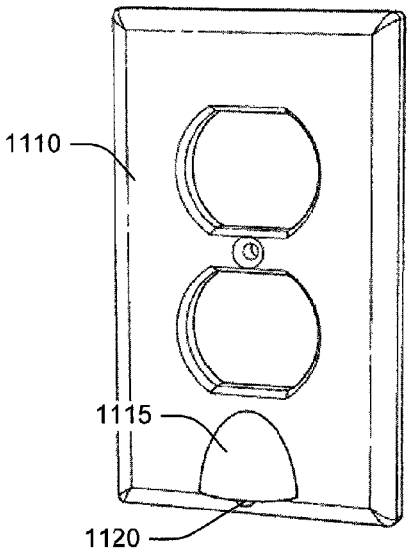
FIG. 11 shows a perspective view of an alternative embodiment of an outlet plate light.
Figure 13:
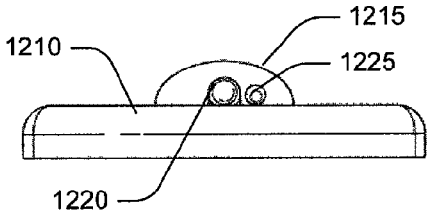
FIG. 13 shows a bottom view of the switch plate light of FIG. 11.
Figure 12:
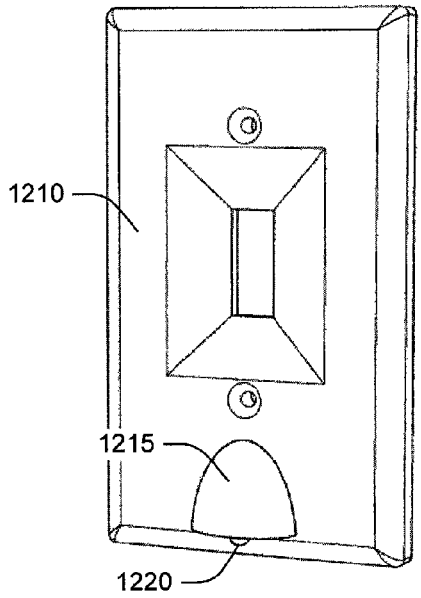
FIG. 12 shows a perspective view of an alternative embodiment of a switch plate light.

FIGS. 11-14 show an alternative embodiment of the switch plate light. FIG. 11 shows a front perspective view for an outlet plate light, and FIG. 12 shows a front perspective view for a switch plate light. As shown in FIG. 11, body 1110 includes a semi-conical hood 1115 that houses LED 1120. As shown in FIG. 12, body 1210 includes a semi-conical hood 1215 that houses LED 1220. FIG. 13 shows a bottom view of switch plate body 1110 including semi-conical hood 1115 and LED 1120. Further, light sensor 1325 may be seen also mounted in semi-conical hood 1115. The bottom view of the outlet plate light shown in FIG. 12 looks substantially similar to the bottom view shown in FIG. 13.

Figure 14:
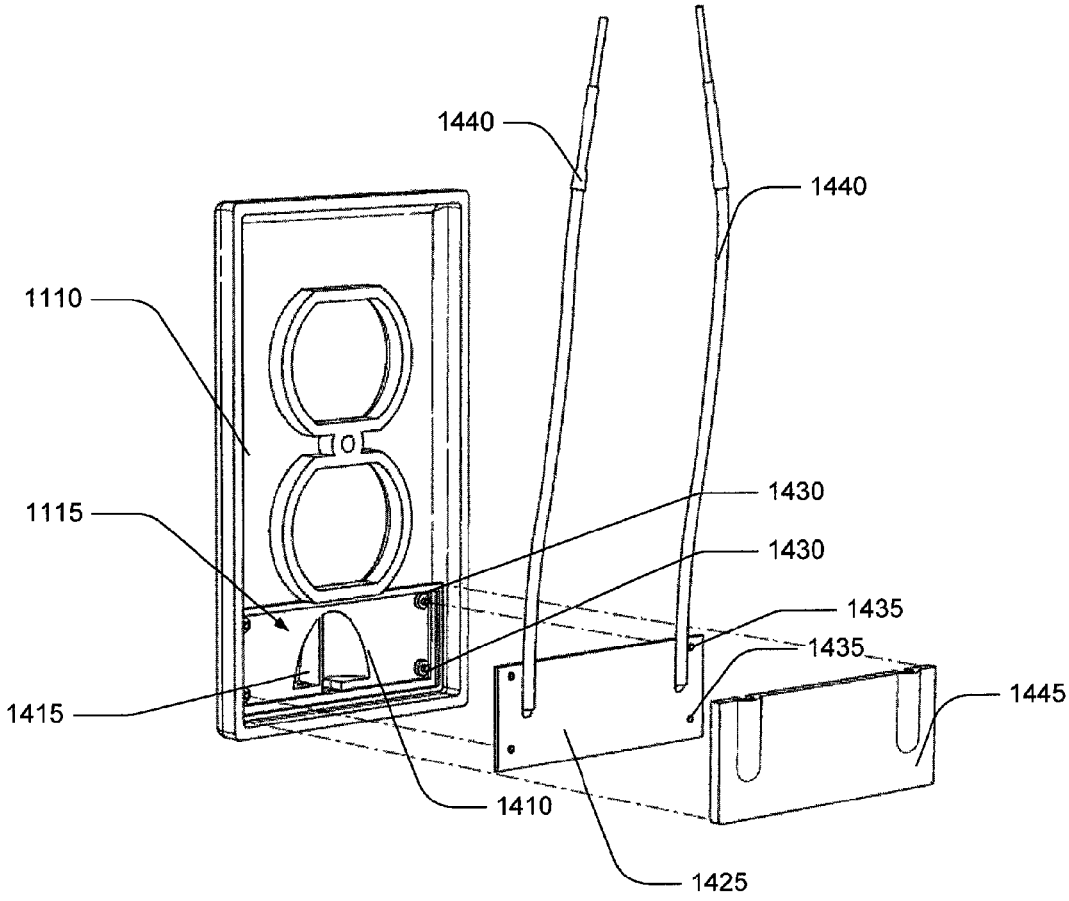
FIG. 14 shows an exploded rear perspective view of the switch plate light of FIG. 11.

FIG. 14 shows an exploded rear perspective view of the outlet plate light of FIG. 11. The switch plate light of FIG. 12 has a similar rear view, except it is adapted to fit a switch instead of outlets. As is clear in FIG. 14, body 1110 includes semi-conical hood 1115. Semi-conical hood 1115 is segmented into two sections, LED section 1410, which is adapted to hold LED 1120, and sensor section 1415 which is adapted to hold light sensor 1325. Circuit slot 1420 is adapted to receive and hold LED driver circuit 1425. Circuit slot 1420 includes pegs 1430 that engage holes 1435 in LED driver circuit 1425. LED driver circuit 1425 includes leads 1440 for connection into the existing circuit box. The leads may be connected to the hot wire and neutral wire of the electrical box, the same wires that the load is connected to. This may be done in the absence of a neutral wire, since the return path is through the load and the draw is sufficiently low so as not to activate the load; and any reactance may be mitigated by an optional reactance mitigation circuit described above. Cover 1445 fits over LED driver circuit 1425 and may be fixed using a snap to fit, friction, glue, or other attachment mechanism.

Another embodiment includes a separate the LED driver circuit from the LED to which it is connected. In this case the driver circuit would reside in a separate module which may be about the size of a thick quarter with wires emanating from it—two wires to the LED and two wires to the AC circuit. The driver module would be "loose" and could be shoved anywhere into the outlet box between the switch or outlet and the inner wall of the box. In this case the switchplate could be made thinner as it would not have to accommodate the driver circuit.

While the above description contains many specifics, these should not be construed as limitations on the scope of the disclosure, but as exemplifications of the presently preferred embodiments thereof. Many other modifications, improvements, and variations are possible and should be readily apparent to those skilled in the art.

The foregoing description of the embodiments of the systems and methods has been presented only for the purpose of illustration and description and is not intended to be exhaustive or to limit the systems and methods to the precise forms disclosed. Numerous modifications and adaptations are apparent to those skilled in the art without departing from the spirit and scope of the systems and methods.

Certain terminology is used herein for convenience only and is not to be taken as a limitation on the embodiments described. In the drawings, the same reference letters are employed for designating the same elements throughout the several figures.

What is claimed is:

1. A switch plate area light for attachment to an electrical box, the switch plate area light comprising:

(a) a body having a first aperture adapted to accommodate an element selected from the list consisting of a switch and an outlet, the body further having a second aperture adapted to accommodate a screw for attaching the body to the electrical box, and the body further having a third aperture, the third aperture located at a light-directing portion of the body;

(b) a light emitting diode (LED) located in the third aperture, wherein the third aperture is adapted to receive the LED; and (c) a driver circuit, connected with the LED and mounted on the body, the driver circuit having a pair of wires to be interconnected with the circuitry of the electrical box without the removal of the electrical box, wherein no ground wire is used to connect the driver circuit and a load borne by the element is not activated when the LED is on, wherein the light-directing portion of the partially conical body protrudes from an outward facing portion of the body.

2. The switch plate area light of claim 1 wherein the driver circuit draws current from an alternating current power source of the electrical box, such that a return path for the current is through an electrical load of the electrical box.

3. The switch plate area light of claim 1 wherein the electrical box is not specifically configured to receive the switch plate area light.

4. The switch plate area light of claim 1 wherein the light-directing portion of the body faces down.

5. The switch plate area light of claim 1, further including a light sensing component mounted on the front of the switch plate and connected with the driver circuit.

6. The switch plate area light of claim 5 wherein the driver circuit is configured to turn off the LED when the ambient light reaches a predetermined level.

7. The switch plate area light of claim 1, further including both an ambient light sensing component and a manually operated switch mounted on the front of the switch plate and associated wiring and modifications to the LED driver circuit configured to turn off the LED when the ambient light reaches a predetermined level and to allow a user to turn off the LED when desired.

8. The switch plate area light of claim 1 wherein a first wire of the pair of wires is connected to a hot wire of the electrical box, and a second wire of the pair of wires is connected to a neutral wire of the electrical box.

9. The switch plate area light of claim 8 wherein the element is connected to the hot wire and the neutral wire.

10. A switch plate area light for attachment to an electrical box, the switch plate area light comprising:

(a) a body having a first aperture adapted to accommodate an element selected from the list consisting of a switch and an outlet, the body further having a second aperture adapted to accommodate a screw for attaching the body to the electrical box, and the body further having a third aperture, the third aperture located at a light-directing portion of the body;

(b) a light emitting diode (LED) located in the third aperture, wherein the third aperture is adapted to receive the LED; and (c) a driver circuit connected with the LED and mounted on the body, the driver circuit having a pair of wires to be interconnected with the circuitry of the electrical box without the modification of the electrical box, wherein the driver circuit includes a current regulating component including an adjustable three-terminal regulator integrated circuit, the regulator having an input terminal, an adjustment terminal, and an output terminal configured such that rectified and filtered current from the current rectifying and filtering components of said LED driver circuit is applied to the input terminal of the regulator, output current to drive an LED is drawn from the adjustment terminal of the regulator, and the output terminal of the regulator is unused.

11. The switch plate area light of claim 10 wherein no modification of the element is needed in order to interconnect the driver circuit.

12. The switch plate area light of claim 10 wherein a first wire of the pair of wires is connected to a hot wire of the electrical box, and a second wire of the pair of wires is connected to a neutral wire of the electrical box.

13. The switch plate area light of claim 12 wherein, when the LED is on, a load borne by the element is not activated.

14. The switch plate area light of claim 13 wherein the element is connected to the hot wire and the neutral wire.

15. The switch plate area light of claim 10 wherein no ground wire is used to connect the driver circuit, and the load borne by the element is not activated when the LED is on.

* * * * *